US006003630A

United States Patent [19]

Whalen

[11] Patent Number: 6,003,630

[45] Date of Patent: Dec. 21, 1999

[54] UNILATERAL SCAFFOLD SYSTEM

[75] Inventor: Gregory J. Whalen, Rapid City, S. Dak.

[73] Assignee: Construction Systems, Inc., Rapid City, S. Dak.

[21] Appl. No.: 09/096,440

[22] Filed: Jun. 11, 1998

Related U.S. Application Data

[63] Continuation-in-part of application No. 08/881,769, Jun. 24, 1997, abandoned.

[51] Int. Cl.[6] ..... E04G 3/00

[52] U.S. Cl. ..... 182/82; 182/150; 182/178.6; 248/235; 248/240.3

[58] Field of Search ..... 182/82, 119, 150, 182/178.1, 178.2, 178.3, 178.4, 178.5, 178.6, 179.1, 182.1, 188; 248/235, 239, 240, 240.3, 246

[56] References Cited

U.S. PATENT DOCUMENTS

| | | | |
|---|---|---|---|
| 2,308,142 | 1/1943 | Alloway | 182/82 X |
| 3,082,843 | 3/1963 | Leonard | 182/82 |
| 3,302,749 | 2/1967 | Heaphy et al. | 182/82 |
| 3,656,580 | 4/1972 | Gostling | 182/82 |
| 3,726,362 | 4/1973 | Puckett | 182/178.6 |
| 4,122,916 | 10/1978 | Strobel | 182/82 |
| 4,262,774 | 4/1981 | Chez | 182/179 |
| 4,372,425 | 2/1983 | Murphy | 182/82 X |
| 4,378,860 | 4/1983 | Newberry | 182/38 |
| 4,452,336 | 6/1984 | Sickler | 182/82 |
| 4,452,337 | 6/1984 | Atzinger | 182/178 |
| 4,565,261 | 1/1986 | Maier | 182/113 |
| 4,640,383 | 2/1987 | Newberry | 182/38 |
| 4,850,453 | 7/1989 | St-Germain | 182/229 |
| 4,891,926 | 1/1990 | Allenbaugh | 52/637 |
| 4,947,962 | 8/1990 | Helsper | 182/182 |
| 4,957,185 | 9/1990 | Courchesne et al. | 182/150 |
| 5,012,894 | 5/1991 | Nelson | 182/178 |
| 5,031,880 | 7/1991 | Sugiyama | 254/375 |
| 5,156,235 | 10/1992 | Preston | 182/82 X |
| 5,291,695 | 3/1994 | Healy et al. | 51/410 |
| 5,299,780 | 4/1994 | Sugiyama | 254/333 |
| 5,316,253 | 5/1994 | Flathau et al. | 248/235 |
| 5,429,339 | 7/1995 | Sugiyama | 254/333 |
| 5,524,727 | 6/1996 | Yennie, Jr. | 182/82 |
| 5,535,974 | 7/1996 | Savitzki | 248/246 |
| 5,638,917 | 6/1997 | Vennen | 182/150 |
| 5,865,410 | 2/1999 | Horen | 182/82 X |

FOREIGN PATENT DOCUMENTS

| | | | |
|---|---|---|---|
| 2102535 | 4/1972 | France | 182/82 |
| 2105393 | 4/1972 | France | 182/82 |
| 4319664 | 2/1995 | Germany | 182/82 |

*Primary Examiner*—David M. Purol
*Assistant Examiner*—Bruce A. Lev
*Attorney, Agent, or Firm*—Welsh & Katz

[57] ABSTRACT

A scaffold system for removable attachment to a wall that includes a vertical support member, a horizontal support member, and an attaching bracket. The vertical support member has a first end and a second end. The horizontal support member has a first end and a second end. The first end of the vertical support member is attached to the horizontal support member so that the vertical support member is substantially perpendicular to the horizontal support member. The attaching bracket extends from the horizontal support member substantially aligned with and parallel to the horizontal support member. The attaching bracket removably attaches the vertical support member and the horizontal support member to the wall.

14 Claims, 10 Drawing Sheets

UNILATERAL SCAFFOLD SYSTEM

REFERENCE TO RELATED APPLICATION

This application is a continuation-in-part of U.S. Ser. No. 08/881,769, which was filed on Jun. 24, 1997, and which is now abandoned.

BACKGROUND OF THE INVENTION

The present invention relates generally to a scaffold system. More particularly, the present invention relates to a scaffold system that is attachable to a wall.

When performing commercial and residential construction, it is commonly necessary to use scaffolding to provide workers access to areas where the work is to be preformed. Many types of scaffolding have been developed to accommodate these situations. For example, Allenbaugh, U.S. Pat. No. 4,891,926, discloses a scaffolding system that permits a person to walk beneath the scaffold. Each scaffold frame includes a pair of triangular-shaped support members and a connecting crosspiece. Allenbaugh indicates that the triangular-shaped support members are separable from the connecting crosspiece so as to enable the scaffold frame to be carried through narrow openings.

Chez, U.S. Pat. No. 4,262,774, describes an adjustable scaffolding system in which a support platform is slidable mounted to legs. Sliding the support platform with respect to the legs allows the height of the scaffold to be adjusted. Each of the legs includes a wheel, which enables the scaffold to be moved along the ground. Helsper, U.S. Pat. No. 4,947,962, describes an adjustable scaffolding support that is in the shape of the letter "A".

Gostling, U.S. Pat. No. 3,656,580, discloses a scaffolding system in which the legs closest to a building wall are attached to the wall. The legs opposite the wall are supported through the ground using an adjustable base.

To avoid the difficulties of preparing the ground to adequately support a scaffolding system in a stationary position with respect to a building, scaffolding systems have been developed that permit the scaffolding system to be attached to the building wall. For example, Savitski, U.S. Pat. No. 5,535,974, describes a scaffold bracket having first and second grippers, which extend around opposite sides of a stud. A downward force on an end of the scaffold bracket opposite the first and second grippers causes the first and second grippers to engage the stud.

St-Germain, U.S. Pat. No. 4,850,453, utilizes a plate imbedded in the mortar of a brick or concrete wall. The scaffold is attached to the plate during construction. After construction is completed, the scaffold is unattached from the plate and the portion of the plate extending from wall is removed.

Flathau et al., U.S. Pat. No. 5,316,253, discloses a triangular-shaped scaffold bracket. The scaffold bracket includes a plank support leg and an attachment leg. The attachment leg includes a plurality of pear-shaped slots that are each adapted to receive a fastening device, such as a bolt, for removably attaching the scaffold bracket to a wall.

Yennie, Jr., U.S. Pat. No. 5,524,727, describes a construction wall bracket that hangs over the top of a wall. The bracket includes a vertical member and a swing arm that is pivotably attached to the top of the vertical member so that the swing arm can extend over the top of the wall. The bracket also includes a horizontal member that extends perpendicularly outward from the vertical member. Yennie, Jr. indicates that the bracket is used during construction of rafters, ceiling joists, or a roof.

SUMMARY OF THE INVENTION

The present invention is a scaffold system for removable attachment to a wall. The scaffold system includes a vertical support member, a horizontal support member, and an attaching bracket.

The vertical support member has a first end and a second end. The horizontal support member has a first end and a second end. The first end of the vertical support member is attached to the horizontal support member so that the vertical support member is substantially perpendicular to the horizontal support member.

The attaching bracket extends from the horizontal support member substantially aligned with and parallel to the horizontal support member. The attaching bracket removably attaches the support member and the horizontal support member to the wall.

DETAILED DESCRIPTION OF THE PREFERRED EMBODIMENTS

Figure 1:
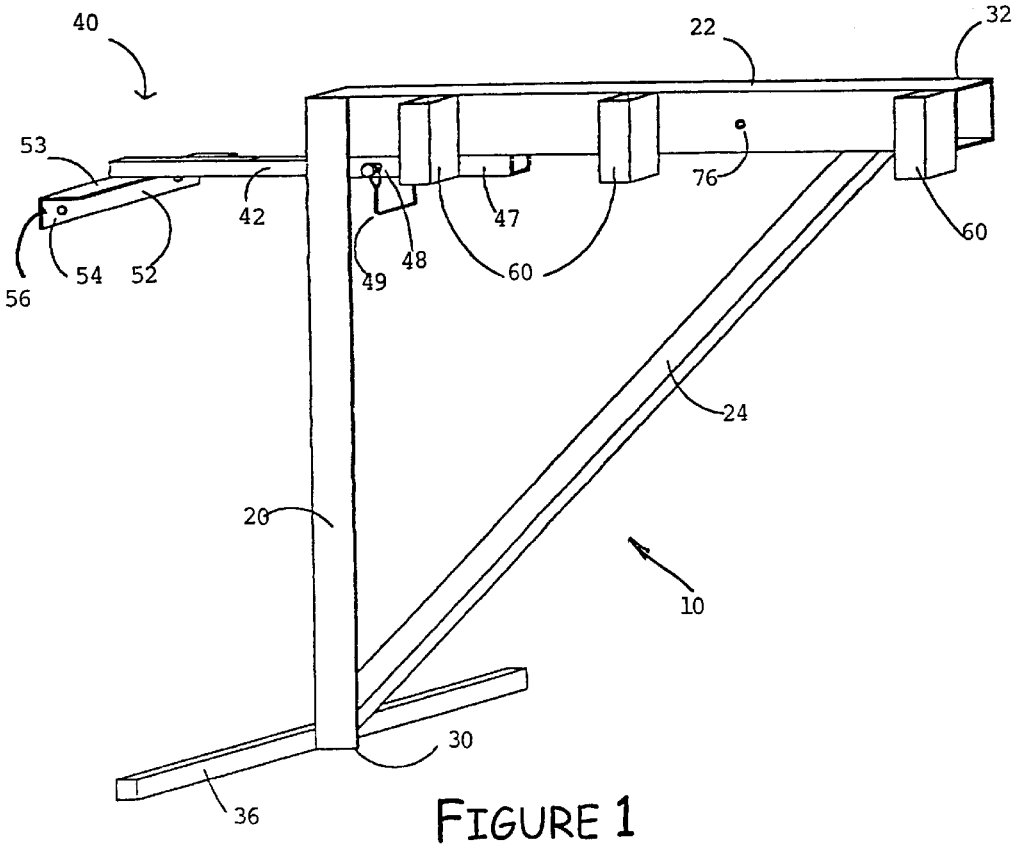
FIG. 1 is a perspective view of a scaffold system according to the present invention.
Figure 2:
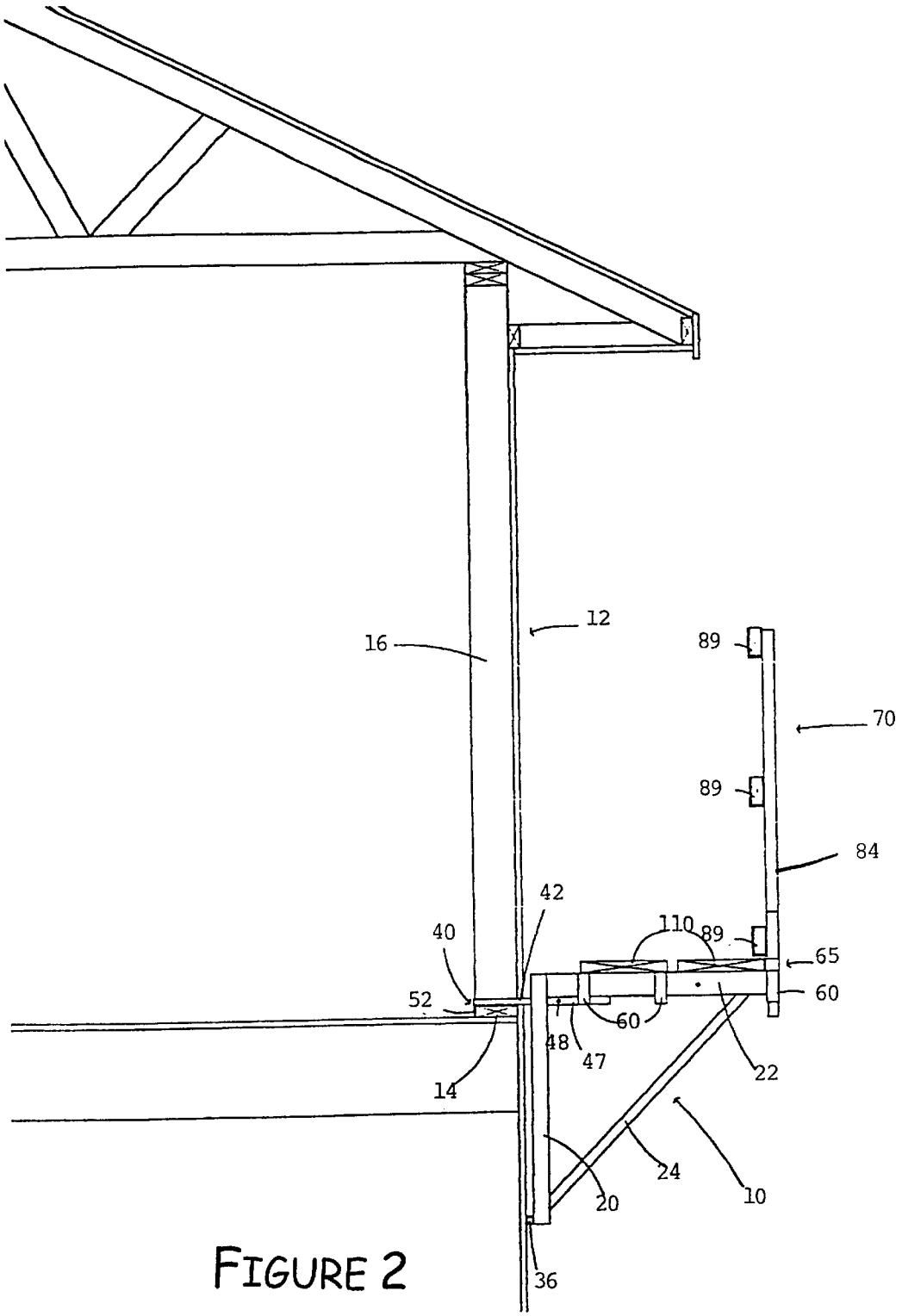
FIG. 2 is a sectional view illustrating the attachment of the scaffold system to the wall.

The present invention is a scaffold system, as most clearly illustrated at 10 in FIGS. 1 and 2. The scaffold system 10 may be readily attached to a support structure. One preferred support structure is a wall 12. The scaffold system 10 may be attached from either the inside of the wall 12 or the outside of the wall 12. The scaffold system 10 does not require a stable ground surface to be prepared for erecting the scaffolding. Additionally, the scaffold system 10 does not interfere with mounting of wall board sheathing or siding on the wall 10.

The scaffold system 10 generally includes a vertical support member 20 and a horizontal support member 22, which is attached to and extends from the vertical support member 20. As used herein, the terms "vertical" and "horizontal" refer to a preferred orientation of the identified components when the scaffold system 10 is removably attached to the wall 12. Use of the terms "vertical" and "horizontal" is not intended to limit the scope of the present invention but rather to assist in visualizing the configuration and use of the scaffold system 10.

The vertical support member 20 is mounted to the horizontal support member 22 so that the vertical support member 20 is substantially perpendicular to the horizontal support member 22. Accordingly, the combination of the vertical support member 20 and the horizontal support member 22 is substantially in the shape of the letter "L".

The vertical support member 20 is preferably in the shape of the letter "L" where each of the legs of the "L" shape have a length of between about 1½ and 2 inches and a thickness of approximately ⅛ of an inch. The vertical support member 20 preferably has a length of between about 24 and 36 inches.

Unless specified otherwise, all components of the scaffold system are fabricated from a metallic material, such as steel or aluminum. A person of ordinary skill in the art will appreciate that when all of the components are formed from metallic materials that the components may be welded together or fastened together with bolts and nuts.

The horizontal support member 22 preferably has a substantially square profile with a width of between about 2 and 3 inches and a thickness of approximately ⅛ of an inch. The horizontal support member 22 is selected with a length that corresponds with a distance that is desired to be away from the wall to which the scaffold system 10 is attached. Preferably, the horizontal support member 22 has a length of between about 24 and 36 inches.

The scaffold system 10 also preferably includes an angle brace 24 that is oriented at an angle with respect to the vertical support member 20 and the horizontal support member 22. The angle brace 24 is preferably attached proximate to an end 30 of the vertical support member 20 that is opposite the horizontal support member 22. Similarly, the angle brace 24 is preferably attached proximate to an end 32 of the horizontal support member 22 that is opposite the vertical support member 20.

The scaffold system 10 also includes a cross brace 36 attached to the vertical support member 20 proximate to the end 30. The cross brace 36 increases the surface area over which an inward force is applied to the wall 12 when weight is placed upon the scaffold system 10. The cross brace 36 is preferably oriented substantially perpendicular to the vertical support member 20. While the cross brace 36 is not attached to the horizontal support member 22, the cross brace 36 is preferably oriented substantially perpendicular to the horizontal support member 22.

The length of the cross brace 36 is selected based on the spacing between vertically oriented studs 16 in the wall 12 so that the cross brace 36 extends between adjacent studs 16. When studs 16 are spaced so that the center of each stud 16 is approximately 16 inches apart, the cross brace 36 is preferably selected with a length of at least 2 feet.

The scaffold system 10 further includes an attaching bracket 40 that slidably engages the horizontal support member 22 by sliding into attaching bracket port 47. The attaching bracket 40 preferably includes an extension arm 42. The extension arm 42 is preferably selected with an outer profile is approximately the same as an inner profile of the attaching bracket port 47. The extension arm 42 is thereby slidable inside of the attaching bracket port 47 in a direction that is substantially aligned with and parallel to the horizontal support member 22.

Figure 3:
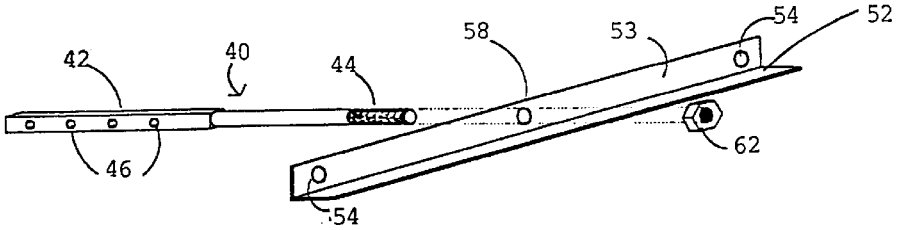
FIG. 3 is a perspective view of an attaching bracket of the scaffold system.

The extension arm 42 includes a plurality of spaced-apart apertures 46 extending therethrough, as most clearly illustrated in FIG. 3. A person of ordinary skill in the art will appreciate that the extension arm 42 may be formed with a large number of apertures 46 to permit the scaffold system 10 to be used with walls 12 having a large number thicknesses by orienting the apertures 46 in other relationships, such as placing the apertures 46 at intervals of approximately 2 inches. The placement of the extension arm apertures 46 preferably permits the scaffold system 10 to be used with walls 12 having thicknesses of between approximately 4 inches and 8 inches for use with masonry walls.

Proximate to an end of the horizontal support member 22 that is attached to the vertical support member 20, the attaching bracket port 47, which is welded to the underside of the horizontal support member 22 includes an aperture 48 extending therethrough, as most clearly illustrated in FIGS. 1 and 2. The attaching bracket port 47 is oriented so that sliding of the extension arm 42 with respect to the attaching bracket port 47 allows one of the extension arm apertures 46 to be aligned with the horizontal support aperture 48. Alignment of one of the extension arm apertures 46 with the horizontal support aperture 48 allows a pin 49 to be extended therethrough to thereby retain the extension arm 42 in a fixed relation with respect to the horizontal support member 22.

The attaching bracket 40 also preferably includes a nail plate 52 attached to the extension arm 42 so that the nail plate 52 is oriented substantially perpendicular to the extension arm 42. The nail plate 52 is preferably in the shape of the letter "L" and has a length of approximately 8 inches.

The nail plate 52 preferably includes at least one aperture 54 that extends through a leg 53 of the nail plate 52 that is attached to extension arm 42. The aperture 54 is selected with a diameter that permits a nail or screw to pass therethrough. Using a nail or screw with the nail plate 52 allows the nail plate 52 to be retained in a desired location on the sill plate 14.

In an alternative embodiment, the attaching bracket 40 includes a threaded portion 44 that extends from an end of the extension arm 42 opposite the end of the extension arm 42 having the apertures 46, as most clearly illustrated in FIG. 3. With this configuration, the nail plate 52 includes an aperture 58 that extends through the leg 53. The aperture 58 is formed with a sufficient diameter to permit the threaded portion 44 to extend therethrough. The attaching bracket 40 in this configuration also includes a threaded nut 62 that threadably engages the threaded portion 44 and thereby retains the extension arm 42 in a fixed relationship with respect to the nail plate 52.

Figure 4:
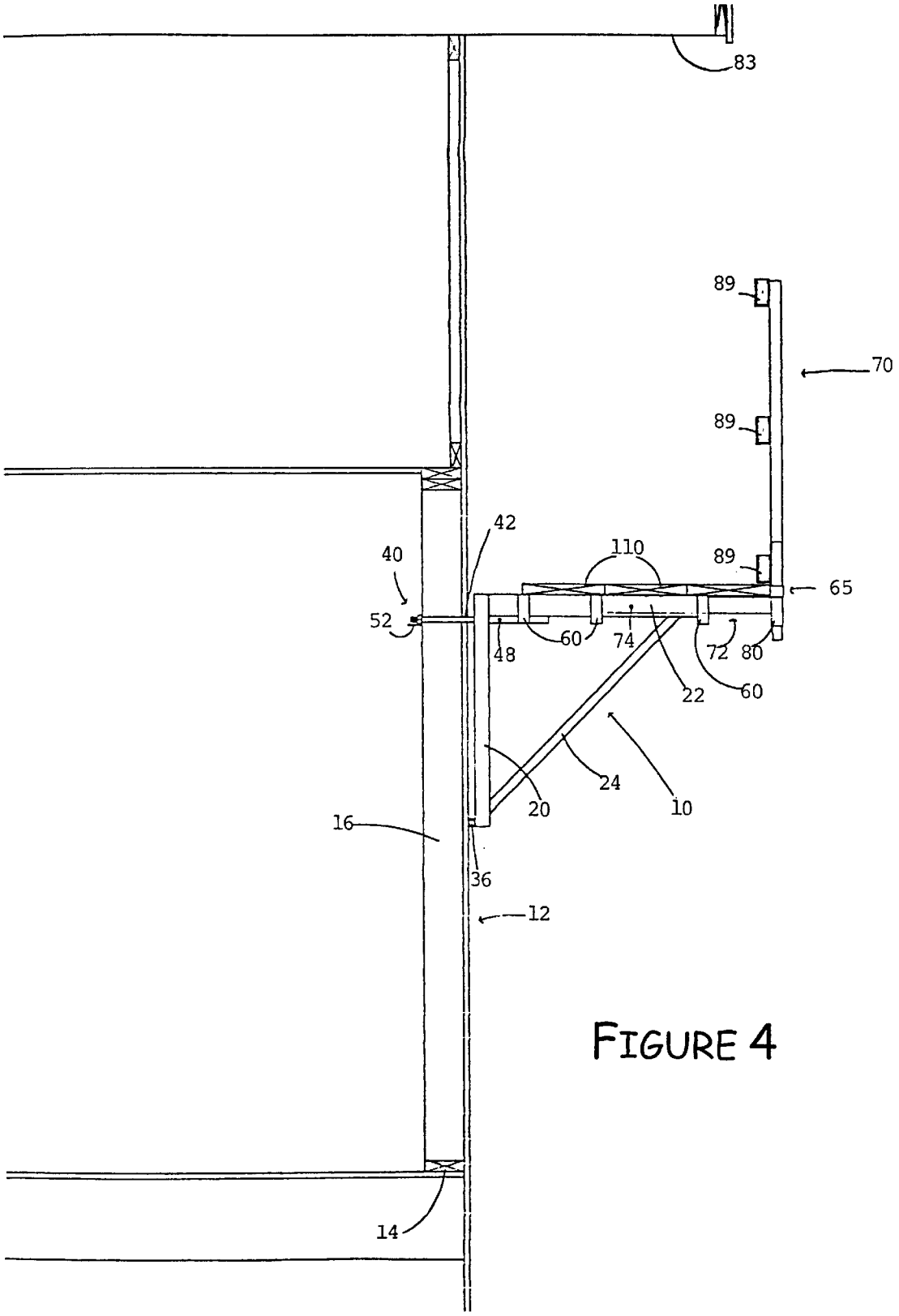
FIG. 4 is a sectional view of an outrigger used with the scaffold system.

When using this configuration of the attaching bracket 40, the scaffold system 10 is suitable for attachment at an intermediate location between a top and bottom of the wall 12, as most clearly illustrated in FIG. 4. Using the scaffold system 10 in this configuration also permits work to be done on the portions of the building that do not offer a conventional plate for access to certain portions of the building from the scaffold system 10. In this configuration, the nail plate 52 has a length of at least 26 inches and preferably greater than 30 inches.

The scaffold system 10 preferably includes a mounting bracket 60 attached to the horizontal support member 22 proximate to the end 32 that is opposite the vertical support member 20, as most clearly illustrated in FIGS. 1 and 2. The mounting bracket 60 is adapted to receive a coupling pin 65, which allows a railing 70 to be removably attached to the scaffold system 10, as most clearly illustrated in FIGS. 2 and 8. The railing 70 protects persons working on the scaffold from falling off the scaffold.

Figure 9:
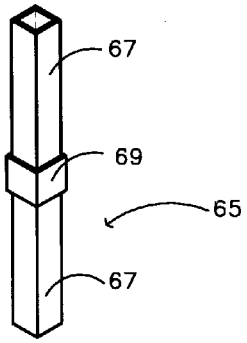
FIG. 9 is a perspective view of an attachment adapter for use with the scaffold system.

The coupling pin 65 has a substantially square profile and includes end portions 67 that extend from opposite ends of a middle portion 69, as most clearly illustrated in FIG. 9. The outer surface of the end portions 67 is approximately the same size as an inner surface of the mounting bracket 60 so that it is possible for the end portion 67 to slide inside of the mounting bracket 60. The wider middle portion 69 limits the distance to which the coupling pin 65 is insertable into the mounting bracket 60.

Figure 5:
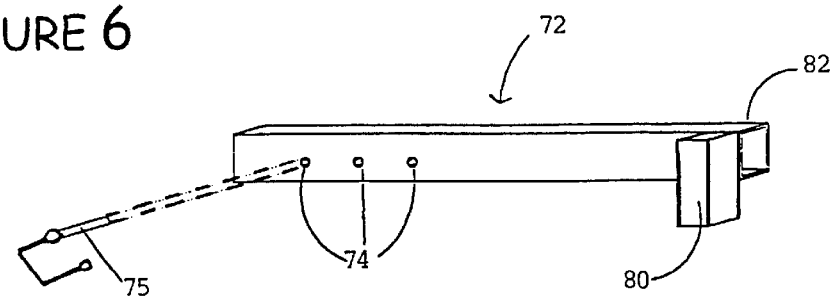
FIG. 5 is a perspective view of the outrigger.

The scaffold system 10 includes the ability to use an outrigger 72, as most clearly illustrated in FIGS. 4 and 5. Using the outrigger 72 with the scaffold system 10 allows a person to perform work located at a greater distance from the wall 12, such as a building overhand 83. The outrigger 72 preferably has a square profile where an outer profile of the outrigger 72 is approximately the same size as an inner profile of the horizontal support member 22. The outrigger 72 is thereby slidable inside of the horizontal support member 22 in a direction that is substantially aligned with and parallel to the horizontal support member 22.

The outrigger 72 includes an aperture 74 that extends therethrough, as most clearly illustrated in FIG. 5. A person of ordinary skill in the art will appreciate that the outrigger 72 may be formed with several apertures 74 that permit the outrigger 72 to be extended several discrete distances from the horizontal support member 22.

Proximate to the end 32 of the horizontal support member 22 opposite the vertical support member 20, the horizontal support member 22 includes an aperture 76 extending therethrough, as most clearly illustrated in FIG. 4. The horizontal support member aperture 76 is oriented so that sliding of the outrigger 72 with respect to the horizontal support member 22 allows one of the outrigger apertures 74 to be aligned with the horizontal support aperture 76. Alignment of one of the outrigger apertures 74 with the horizontal support aperture 76 enables a pin 75 to be extended therethrough to thereby retain the outrigger 72 in a fixed relation with respect to the horizontal support member 22.

Similar to the horizontal support member 22, the outrigger 72 preferably includes a mounting bracket 80 attached to the outrigger 72 proximate to an end 82 of the outrigger that is opposite the horizontal support member 22. The mounting bracket 80 is adapted to receive coupling pin 65 which in turn receives a railing 70.

Figure 8:
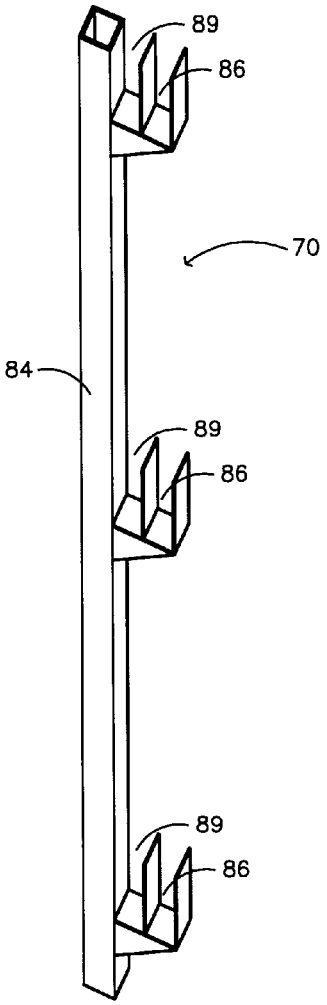
FIG. 8 is a perspective view of a support rail for use with the scaffold system.

The railing 70 used in conjunction with the scaffold system 10 of the present invention preferably includes three rail pockets 89, as most clearly illustrated in FIGS. 2 and 8. Depending on the spacing between individual scaffold system units 10, it may be desirable to form the railing with arms made of standard wood 2×4 into rail pockets 89. Similarly, depending on the height of the cross member 86, it may be desirable to include additional cross members (not shown) at intermediate locations on the side arms 84.

Figure 6:
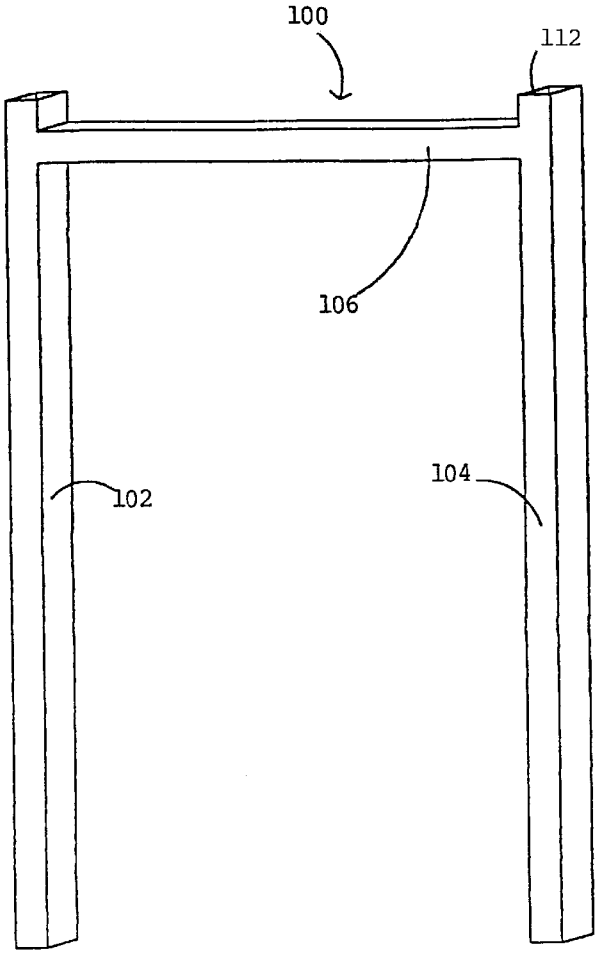
FIG. 6 is a perspective view of a vertical extension frame for use with the scaffold system.
Figure 7:
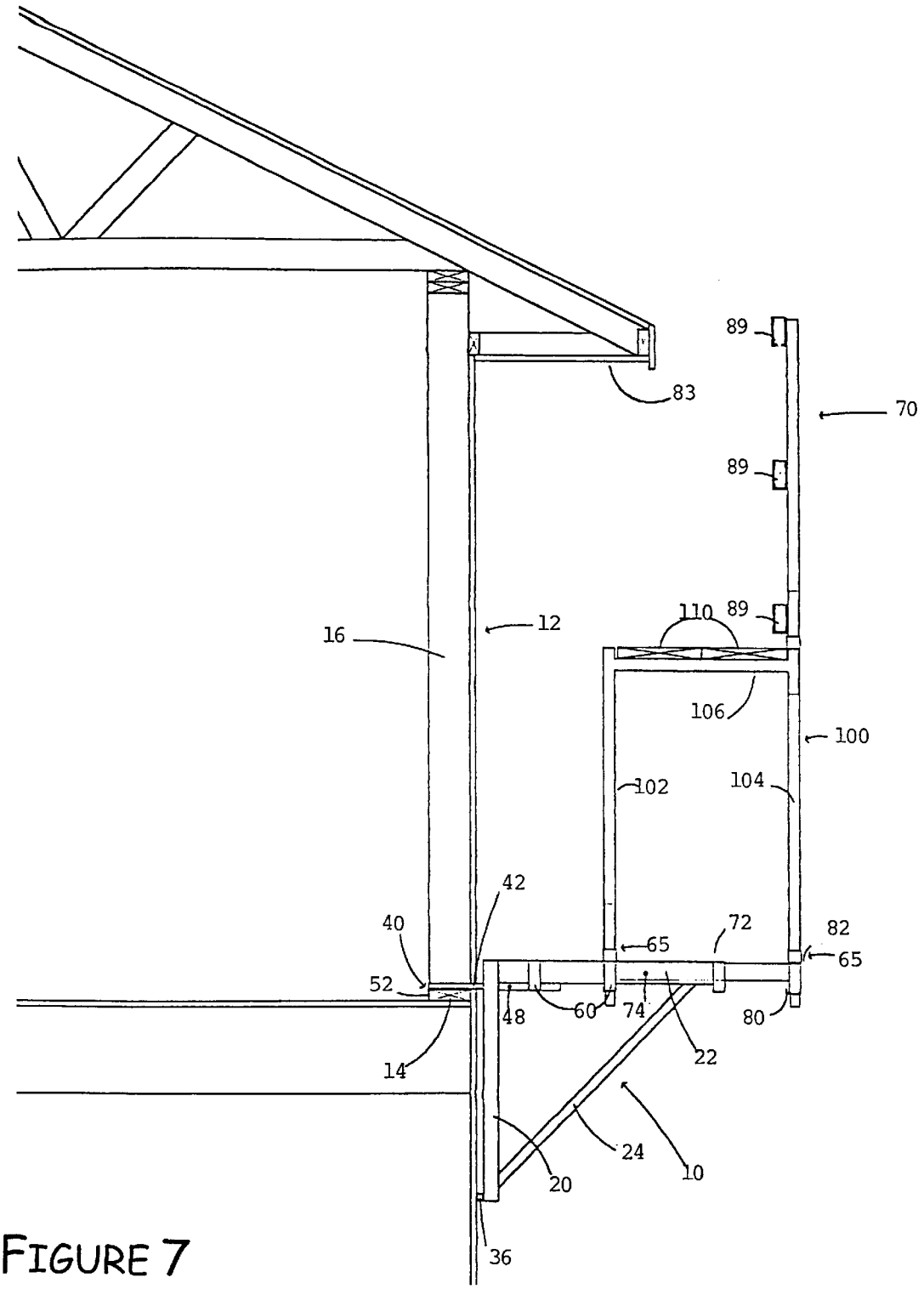
FIG. 7 is a sectional view of a height extension used with the scaffold system.

The scaffold system 10 of the present invention also includes a height extension adapter 100, as most clearly illustrated in FIGS. 6 and 7. The height extension adapter 100 includes a front side arm 102, a back side arm 104, and a cross member 106 that extends between the front and back side arms 102, 104. The front and back side arms 102, 104 are selected with a profile that permits the front and back side arms 102, 104 to engage coupling pins 65 resting in mounting brackets 60. The front and back side arms 102, 104 preferably extend above the cross member 106 to a height that is approximately level with a top surface of wood planks 110 placed on the cross member 106. The back side arm 104 includes an aperture 112 that is adapted to receive coupling pin 65 on the railing 70.

FIG. 7 also illustrates that the height extension adapter 100 may be used in conjunction with the outrigger 72 by using mounting brackets 60 and 80 in combination with coupling pins 65.

An advantage of the present invention is that the scaffold system can be erected from inside of the building. In particular, when using the embodiment illustrated in FIG. 2, the scaffold system 10 may be rotated and the passed between adjacent studs 16 to assemble the scaffold system 10. Once the cross brace 36 is passed the outer surface of the studs 16, the scaffold system 10 is rotated until the vertical support member 20 is in a substantially vertical orientation. The attaching bracket 40 is then placed so that the nail plate 52 is adjacent to the sill plate of the wall 12. The scaffold system 10 is then pivoted until the cross brace 36 rests against an outer surface of the wall 12. The scaffold system 10 is then anchored in place by driving nails through the nail plate 52 and into the sill plate 14.

The process is repeated to place other scaffold system units 10 along the wall 12. For most applications, the scaffold system units 10 are spaced approximately 10 to 12 feet apart from each other. Once all of the scaffold system units 10 are in place, planks 110 are placed on top of the horizontal support member 22 or cross bar 106 to thereby provide a surface that may be walked on when performing work on the wall or above the wall. A person of ordinary skill in the art will appreciate that the type and number of planks 110 used with the scaffold system depends on the spacing between the scaffold system units as well as the intended loads that are to be placed upon the scaffold system 10.

Another embodiment of the present invention is designed for use with an alternative support structure. In particular, the scaffold system 111 is adapted to be mounted to a pole (not shown) that preferably has a substantially square profile, as most clearly illustrated in FIG. 10. One type of pole that is particularly suitable for use with this embodiment has sides that are each approximately 4 inches long.

Figure 11:
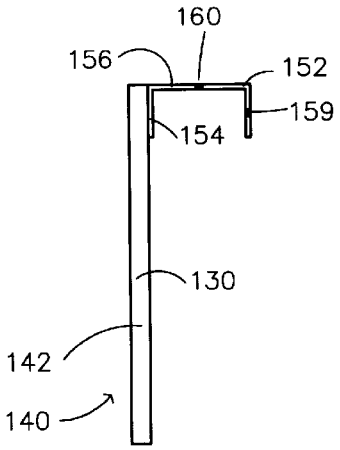
FIG. 11 is a top view of a top portion of the attaching bracket illustrated in FIG. 10.

In this embodiment, the vertical support member 120, the horizontal support member 122, the angle brace 124, and the cross brace 136 are preferably substantially the same as in the embodiment illustrated in FIG. 1. The attaching bracket 140 includes an upper portion 130 and a lower portion 132, as most clearly illustrated in FIG. 11. The upper portion 130 has an extension arm 142 and a bracket 152.

Similar to the extension 42 illustrated in FIG. 1, the extension arm 142 preferably has a substantially square profile and includes at least one aperture 148 formed therein for retaining the extension arm 140 in a fixed relation to the other portions of the scaffold system using a pin 149.

The bracket 152 has a first leg portion 154, a second leg portion 156, and a third leg portion 158 that are configured in a substantially U-shape. A distance between the first portion 154 and the third portion 158 is approximately the same as the length of a side of the pole to which the bracket 152 is to be attached. To facilitate attaching the bracket 152 to the pole, the second portion 156 has at least one aperture 160 formed therein. The aperture 160 is adapted to receive a mounting device (not shown), such as a screw or a nail.

Figure 12:
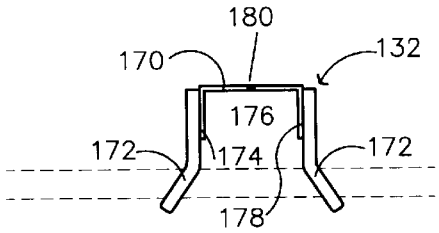
FIG. 12 is a top view of a bottom portion of the attaching bracket illustrated in FIG. 10.
Figure 13:
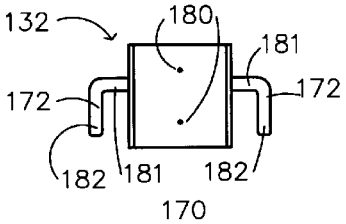
FIG. 13 is a side view of the bottom portion of the attaching bracket illustrated in FIG. 10.

The lower portion 132 has a bracket 170 and a pair of arms 172 extending therefrom, as most clearly illustrated in FIGS. 12 and 13. The bracket 170 has a first leg portion 174, a second leg portion 176, and a third leg portion 178 that are configured in a substantially U-shape. A distance between the first portion 174 and the third portion 178 is approximately the same as the length of a side of the pole (not shown) to which the bracket 170 is to be attached. To facilitate attaching the bracket 170 to the pole (not shown), the second portion 176 has at least one aperture 180 formed therein. The aperture 180 is adapted to receive a mounting device (not shown), such as a screw or a nail.

One of the arms 172 is attached to the first leg portion 174 and the second leg portion 176. Each arm 172 preferably includes a horizontal portion 181 and a vertical portion 182 that extends from the horizontal portion 181, as most clearly illustrated in FIG. 12. The horizontal portion 181 of each arm preferably includes an outward bend, as most clearly illustrated in FIG. 12.

Figure 10:
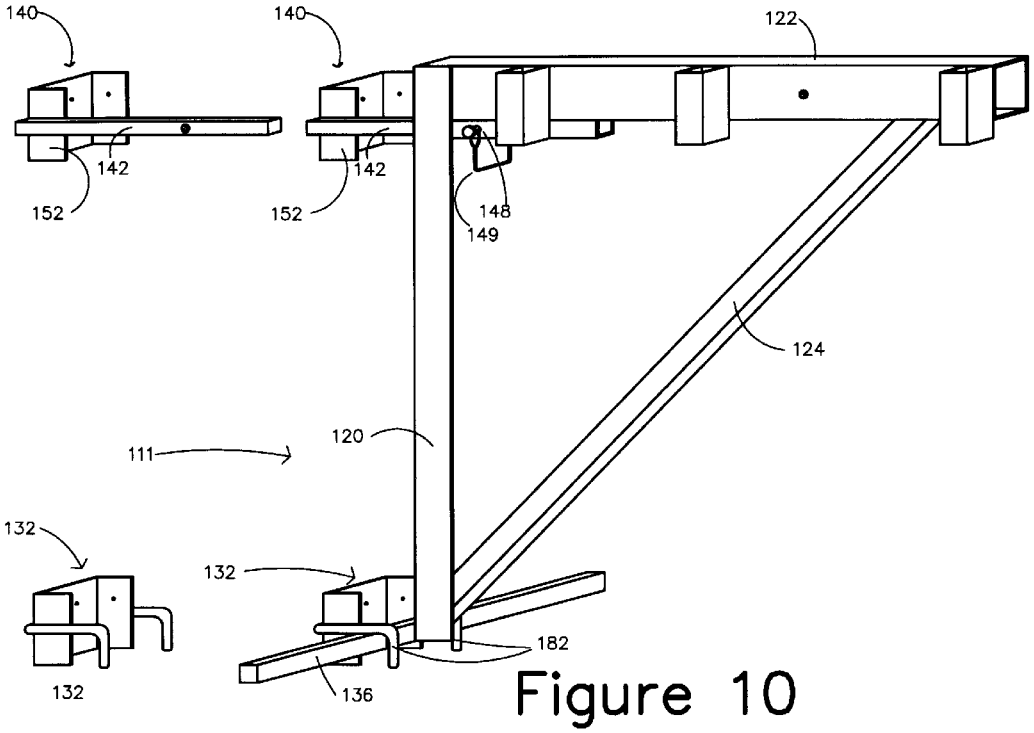
FIG. 10 is a perspective view of an alternative attaching bracket used with the scaffold system.

The lower portion 132 is preferably attached to the cross brace 136 with a pair of sleeves 184, as most clearly illustrated in FIG. 10. The sleeves 184 are each adapted to receive one of the vertical portions 182. A distance between the second portion 176 and the cross brace 136 is preferably approximately the same as the length of a side on the pole (not shown).

Yet another embodiment of the present invention is designed for use with an alternative support structure. In particular, the scaffold system 210 is mounted to a ladder 212, as most clearly illustrated in FIG. 14. In this embodiment, the vertical support member 220, the horizontal support member 222, and the angle brace 224 are preferably substantially the same as in the embodiment illustrated in FIG. 1. The attaching bracket 240 includes an upper portion 230 and a lower portion 232. The upper portion 230 is preferably substantially the same as the attaching bracket illustrated in FIG. 1. The upper portion 230 engages an upper rung 214 on the ladder 212.

The lower portion 232 engages a lower rung 216 on ladder 212 and thereby prevents the scaffold system 210 from rotating with respect to the ladder 212. A person of ordinary skill in the art will appreciate that it is possible to have one or more additional rungs 218 on the ladder 212 between the upper rung 214 and the lower rung 216.

Figure 14:
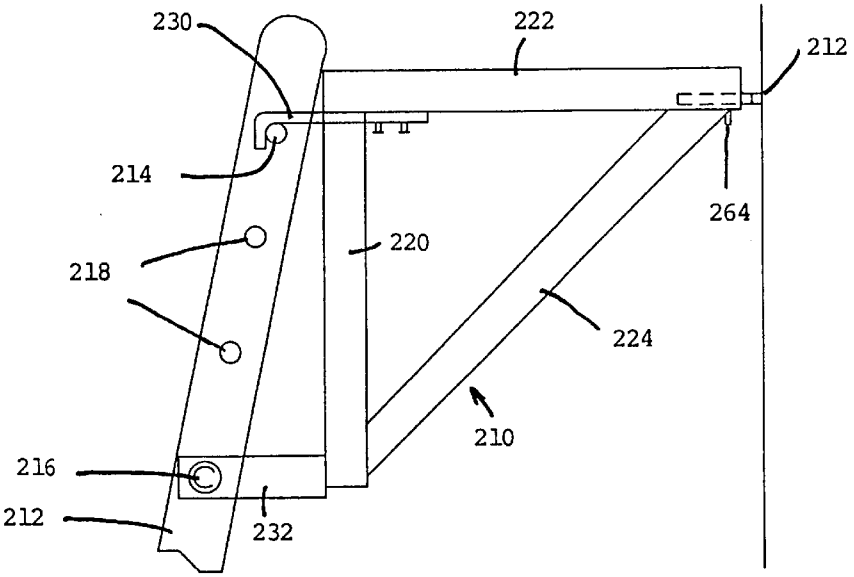
FIG. 14 is a side view of yet another alternative attaching bracket used with the scaffold system.

While only one lower portion 232 is illustrated in FIG. 14, the scaffold system 210 preferably includes two lower portions 232 so that one of the lower portions 232 engages each end of the lower rung 216. However, a person of ordinary skill in the art will appreciate that it is also possible to use alternate structures for attaching the lower end of the scaffold system 210 to the ladder 212.

Figure 15:
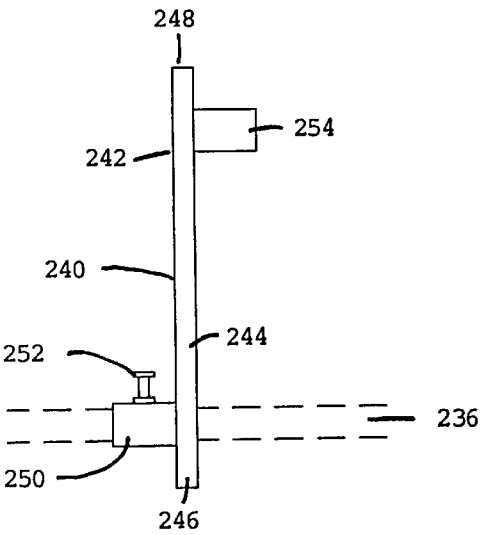
FIG. 15 is a top view of a bottom portion of the attaching bracket illustrated in FIG. 14.

The lower portion 232 preferably includes a main portion 240 with a first side 242 and a second side 244, as most clearly illustrated in FIG. 15. The main portion 240 also preferably includes a first end 246 and a second end 248. The lower portion 232 preferably includes a sleeve 250 that extends from the first side 242 proximate the first end 246. The sleeve 250 preferably has a substantially square profile with an inner diameter that is approximately the same as the outer diameter of the cross brace 236 so that the sleeve 250 is slidable over the cross brace 236. A fastening device 252, such as a screw, extends through the sleeve 250 and engages the cross brace 236 to retain the lower portion 232 in a desired position with respect to the cross brace 236.

The lower portion 232 also includes a projection 254 extending from the second side 244 proximate the second end 248. The projection 254 engages the lower rung 216 and thereby prevents the scaffold system 210 from pivoting with respect to the ladder 212.

Figure 16:
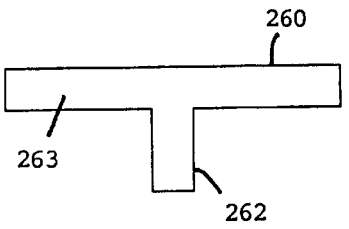
FIG. 16 is a top view of a lower attaching bracket for the scaffold system illustrated in FIG. 14.

To enhance the stability of the scaffold system 210 when placed against a wall (not shown), the scaffold system 210 includes a stabilizing bar 260, as most clearly illustrated in FIG. 14. The stabilizing bar 260 has a top leg 263 and a center leg 262 that are generally in a T-shape, as most clearly illustrated in FIG. 16. The center leg 262 of the stabilizing bar 260 is preferably removably attached to the horizontal bar 222 using a pin 264.

Figure 17:
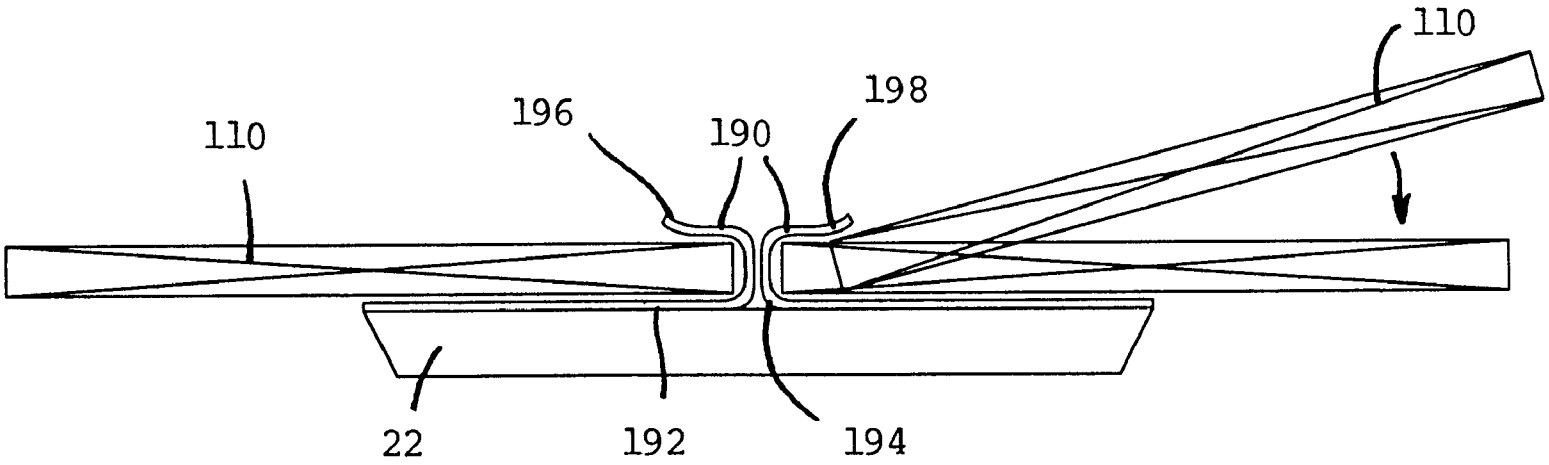
FIG. 17 is a sectional view of a plank mounting bracket for use with the scaffold system.

Another aspect relates to attaching planks 110 to the scaffold system 10 to prevent the planks 110 from moving with respect to the scaffold system 10. The planks 110 are preferably attached to the scaffold system 10 using at least mounting bracket 190, as most clearly illustrated in FIG. 17.

The mounting brackets 190 include a first leg portion 192, a second leg portion 194, and a third leg portion 196 that are in J-shape. A distance between the first leg portion 192 and the third leg portion 196 is preferably approximately the same as the thickness of the plank 110. The third leg portion 196 is preferably outwardly flared to enhance the ability to engage the plank 110 in the mounting bracket 190. The third leg portion 196 also preferably includes at least one aperture 198 formed therein for preventing the plank 110 from moving with respect to the mounting bracket 190.

Although the present invention has been described with reference to preferred embodiments, workers skilled in the art will recognize that changes may be made in form and detail without departing from the spirit and scope of the invention.

What is claimed is:

1. A scaffold system for removable attachment to a support structure, the scaffold system comprising:

a vertical support member having a first end and a second end;

a horizontal support member having a first end and a second end, wherein the first end of the vertical support member is attached to the horizontal support member so that the vertical support member is substantially perpendicular to the horizontal support member;

an attaching bracket port attached to the horizontal support member; and an attaching bracket extending from the horizontal support member, the attaching bracket comprising:

an extension arm having an outer profile that is approximately the same as an inner profile of the attaching bracket port such that the extension arm is slidable through the attaching bracket port; and a nail plate attached to the extension arm substantially perpendicular to the extension arm, and wherein the nail plate is capable of engaging the support structure for removably attaching the vertical support member and the horizontal support member to the support structure.

2. The scaffold system of claim 1, wherein the extension arm has a threaded portion, wherein the nail plate has an aperture extending therethrough, and wherein the nail plate is retained in a fixed position with respect to the extension arm by inserting the threaded portion through the aperture and then engaging the threaded portion with a threaded nut.

3. The scaffold system of claim 1, and further comprising an angle brace extending between an end of the horizontal support member that is opposite the vertical support member to an end of the vertical support member that is opposite the horizontal support member.

4. The scaffold system of claim 1, and further comprising a cross brace attached proximate to an end of the vertical support member that is opposite the horizontal support member and oriented so that the cross brace is substantially perpendicular to the vertical support member.

5. The scaffold system of claim 1, and further comprising a mounting bracket attached to the horizontal support member, wherein the mounting bracket is adapted to receive an end of a railing for retaining the railing in a fixed relation to the horizontal support member.

6. The scaffold system of claim 1, and further comprising an outrigger having outer profile that is approximately the same as an inner profile of the horizontal support member, wherein the outrigger is slidable substantially aligned with and parallel to the horizontal support member.

7. The scaffold system of claim 1, and further comprising a height extension adapter that engages the horizontal support member.

8. The scaffold system of claim 7, wherein the height extension adapter comprises:

a front side arm;

a back side arm; and a cross member extending between the front and back side arms, wherein the horizontal support member includes mounting brackets that are adapted to receive an end of the front and back side arm to removably attach the height extension adapter to the horizontal support member.

9. The scaffold system of claim 1, and further comprising a mounting clip for removably attaching a plank to the horizontal support member, wherein the mounting clip includes a first portion, a second portion, and a third portion that are configured in a substantially J-shape that is adapted to receive the plank, and wherein the first portion is attached to the horizontal support member.

10. A scaffold system for removable attachment to a vertically-oriented wall, the scaffold system comprising:

a vertical support member having a first end and a second end;

a horizontal support member having a first end and a second end, wherein the first end of the vertical support member is attached to the horizontal support member so that the vertical support member is substantially perpendicular to the horizontal support member;

an attaching bracket port attached to the horizontal support member; and an attaching bracket comprising:

an upper portion comprising:

an extension arm having an outer profile that is approximately the same as an inner profile of the attaching bracket port such that the extension arm is slidable through the attaching bracket port; and a bracket attached to the extension arm, wherein the bracket is capable of engaging the vertically-oriented wall; and a lower portion that engages the scaffold system proximate a lower end of the vertical support member, and wherein the lower portion is capable of engaging the vertically-oriented wall.

11. The scaffold system of claim 10, wherein the lower portion comprises bracket and a pair of arms extending therefrom, wherein the bracket is capable of engaging the pole and wherein the arms are capable of engaging the scaffold system proximate the lower end of the vertical support member.

12. A scaffold system for removable attachment to a ladder, the scaffold system comprising:

a vertical support member having a first end and a second end;

a horizontal support member having a first end and a second end, wherein the first end of the vertical support member is attached to the horizontal support member so that the vertical support member is substantially perpendicular to the horizontal support member;

an attaching bracket port attached to the horizontal support member; and an attaching bracket comprising:

an upper portion comprising:

an extension arm having an outer profile that is approximately the same as an inner profile of the attaching bracket port such that the extension arm is slidable through the attaching bracket port; and a bracket attached to the extension arm, wherein the bracket is capable of engaging an upper rung on the ladder; and a lower portion that engages the scaffold system proximate a lower end of the vertical support member, wherein the lower portion is capable of engaging a lower rung on the ladder, and wherein the lower portion is longer than the upper portion so that the lower end of the vertical support member is maintained further away from the ladder than an upper end of the vertical support member when the scaffold system is attached to the ladder.

13. The scaffold system of claim 12, wherein the lower portion is capable of removably attaching the lower end of the vertical support member to the ladder.

14. The scaffold system of claim 12, and further comprising a stabilizing bar that engages the horizontal support member opposite the vertical support member, wherein the stabilizing bar comprises a top leg and a center leg that extends from the top leg substantially in a substantially T-shaped configuration.

* * * * *